US006672447B2

(12) United States Patent
Müller

(10) Patent No.: US 6,672,447 B2
(45) Date of Patent: Jan. 6, 2004

(54) PROCESS AND APPARATUS FOR COMBINING SHEET-LIKE ARTICLES AND JOINTLY TRANSPORTING THEM FURTHER

(75) Inventor: Erwin Müller, Dürnten (CH)

(73) Assignee: Ferag AG, Hinwil (CH)

( * ) Notice: Subject to any disclaimer, the term of this patent is extended or adjusted under 35 U.S.C. 154(b) by 0 days.

(21) Appl. No.: 10/207,530

(22) Filed: Jul. 29, 2002

(65) Prior Publication Data

US 2003/0019722 A1 Jan. 30, 2003

(30) Foreign Application Priority Data

Jul. 30, 2001 (CH) ..... 2001 1417/01

(51) Int. Cl.[7] ..... B65G 47/84

(52) U.S. Cl. ..... 198/478.1; 270/52.19; 271/85

(58) Field of Search ..... 198/803.1, 478.1, 198/470.1, 803.3, 803.4; 271/82, 85, 204, 205; 270/52.14, 52.19, 52.25

(56) References Cited

U.S. PATENT DOCUMENTS 3,122,362 A * 2/1964 Vollrath et al. ..... 270/52.19
3,951,399 A 4/1976 Reist
4,471,953 A 9/1984 Reist et al.
5,110,116 A * 5/1992 Kobler et al. ..... 270/52.14 X
5,188,349 A 2/1993 Honegger
5,632,476 A * 5/1997 Stauber ..... 270/52.19
6,139,252 A 10/2000 Honegger
6,161,827 A 12/2000 Eugster et al.
6,311,968 B1 * 11/2001 Linder et al. ..... 270/52.19 X

* cited by examiner

*Primary Examiner*—James R. Bidwell
(74) *Attorney, Agent, or Firm*—Alston & Bird LLP

(57) ABSTRACT

A process and apparatus for conveying flexible sheet-like articles 26, wherein the articles are fed to a first curved section 14 by means of a delivery conveyor 10 which includes spaced apart transporting clamps 22 for retaining the articles in a hanging position. Arranged in a radially inward direction at the curved section 14, is a gripper wheel 36 with circumferentially distributed grippers 40 and respective supporting elements 52. The gripper wheel 36 is driven at the same angular velocity as the transporting clamps 22 in the curved section 14. However, a single gripper 40 is assigned in each case to two transporting clamps 22. The lower free edges 32 of the two articles 26 to be joined are guided by a supporting element 52 into a gripper 40, and as soon as this has taken place, the relevant gripper 40 is closed, and the relevant transporting clamps 22 then release the articles 26. The associated supporting element 52 is then drawn back inward in the radial direction.

15 Claims, 4 Drawing Sheets

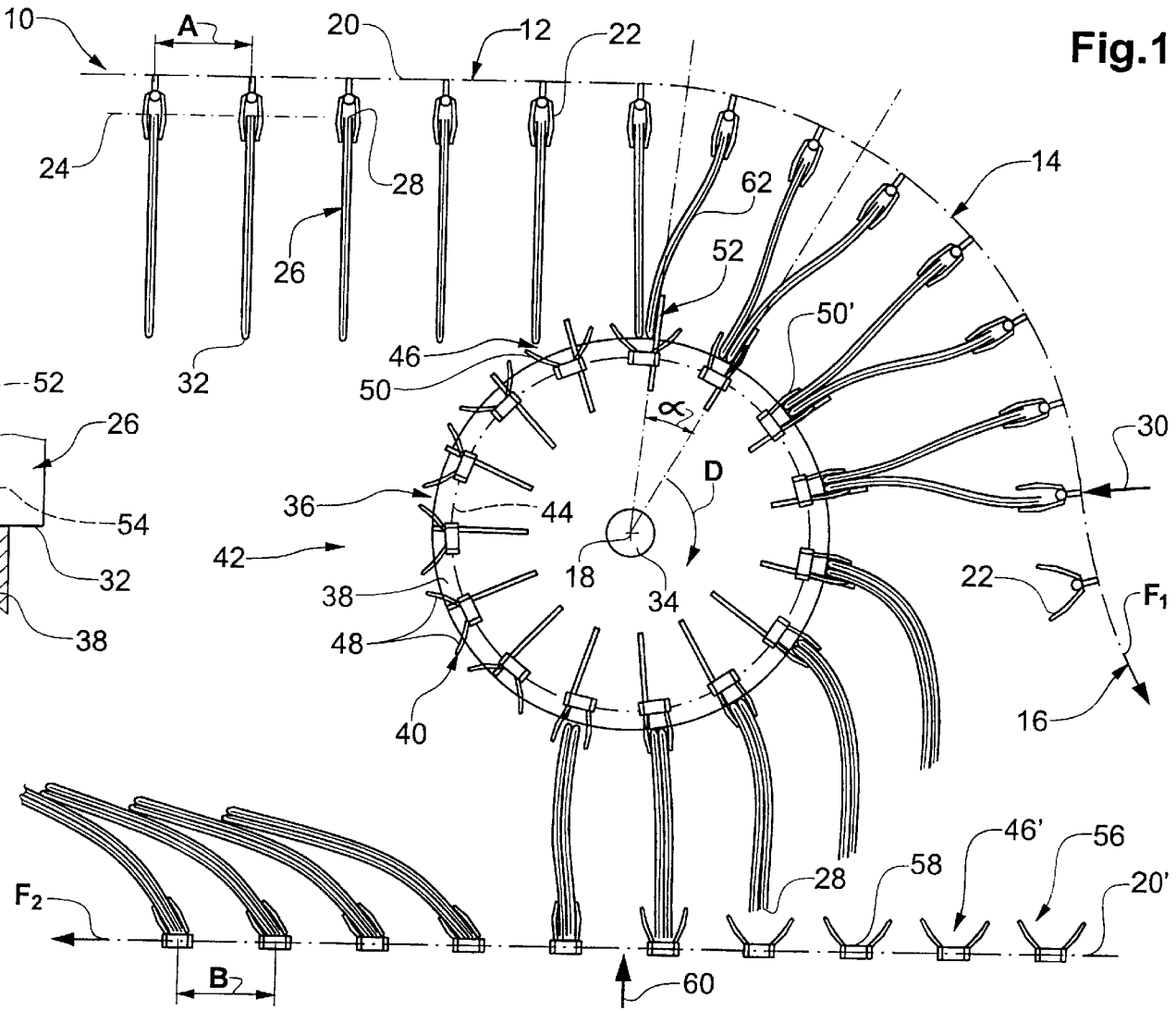
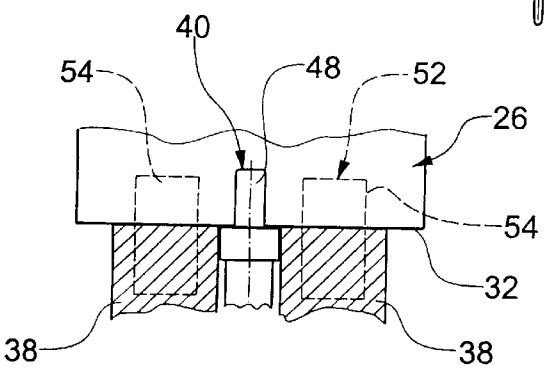
Fig.2

10
12
14
16
18
20
22
24
26
28
30
32
34
38
40
42
44
46
48
50
50'
52
62
64
D
F1
F2

26
32
38
40
48
52
54
64

10
12
14
16
18
20
22
24
26
28
30
32
34
36
38
40
42
44
46
48
50
50'
52
60
62
66
68
D
F1

PROCESS AND APPARATUS FOR COMBINING SHEET-LIKE ARTICLES AND JOINTLY TRANSPORTING THEM FURTHER

BACKGROUND OF THE INVENTION

The present invention relates to a process and to an apparatus for combining in each case at least two flexible, sheet-like articles and jointly transporting them further.

In printing plants, in particular the dispatch rooms thereof and in factories which process printed products, the printed products often arrive in a state in which they are retained individually by transporting clamps of a conveyor. This method of transportation, in particular in the case of large processing capacities, involves high conveying speeds, which may be disadvantageous for the printed products themselves, but also for the smoothness and service life of the conveying equipment.

It is thus an object of the present invention to provide a process in the case of which, and to provide an apparatus by means of which, individually transported flexible sheet-like articles can easily be combined in order for in each case two or more articles to be jointly transported further.

SUMMARY OF THE INVENTION

The above and other objects and advantages of the invention are achieved by the provision of a process and apparatus wherein a delivery conveyor is provided for successively conveying a plurality of the articles in a conveying direction along a conveying path which contains a curve, with the articles being individually retained at a first radially outer edge. Upon reaching the region of the curve, the articles being conveyed are sequentially gripped together in groups of at least two articles by means of a gripper which grips a second radially inner edge of the articles. Then, the gripped articles are released by the transporting clamps of the delivery conveyor, so that the articles maybe jointly transported further.

The grippers may be mounted on a gripper wheel or an endless conveyor wherein a plurality of the grippers are moved along a circulatory path located generally inside the curve of the conveying path. The two articles retained by each gripper may be transferred to transporting grippers of a removal conveyor for being transported further, or where the grippers are mounted on an endless conveyor the articles may be transported away by the endless conveyor. Still further, the joined articles may be transferred back to alternate clamps of the delivery conveyor.

The process according to the invention and the apparatus according to the invention allow in each case at least two flexible sheet-like articles to be combined during transportation without the articles having to be stopped or stacked. While maintaining careful handling of the articles, this allows large processing capacities along with a smooth operation of the corresponding apparatus.

BRIEF DESCRIPTION OF THE DRAWINGS

The invention will be explained in more detail with reference to several embodiments illustrated in the drawings, in which, purely schematically:

FIG. 1 shows a view of a conveyor by means of which the articles arriving are transported to a gripper wheel, by means of which in each case two of the articles are combined and transferred to a removal conveyor;

FIG. 2 shows an axial section of part of the gripper wheel from FIG. 1;

DETAILED DESCRIPTION OF THE PREFERRED EMBODIMENTS

Figure 3:
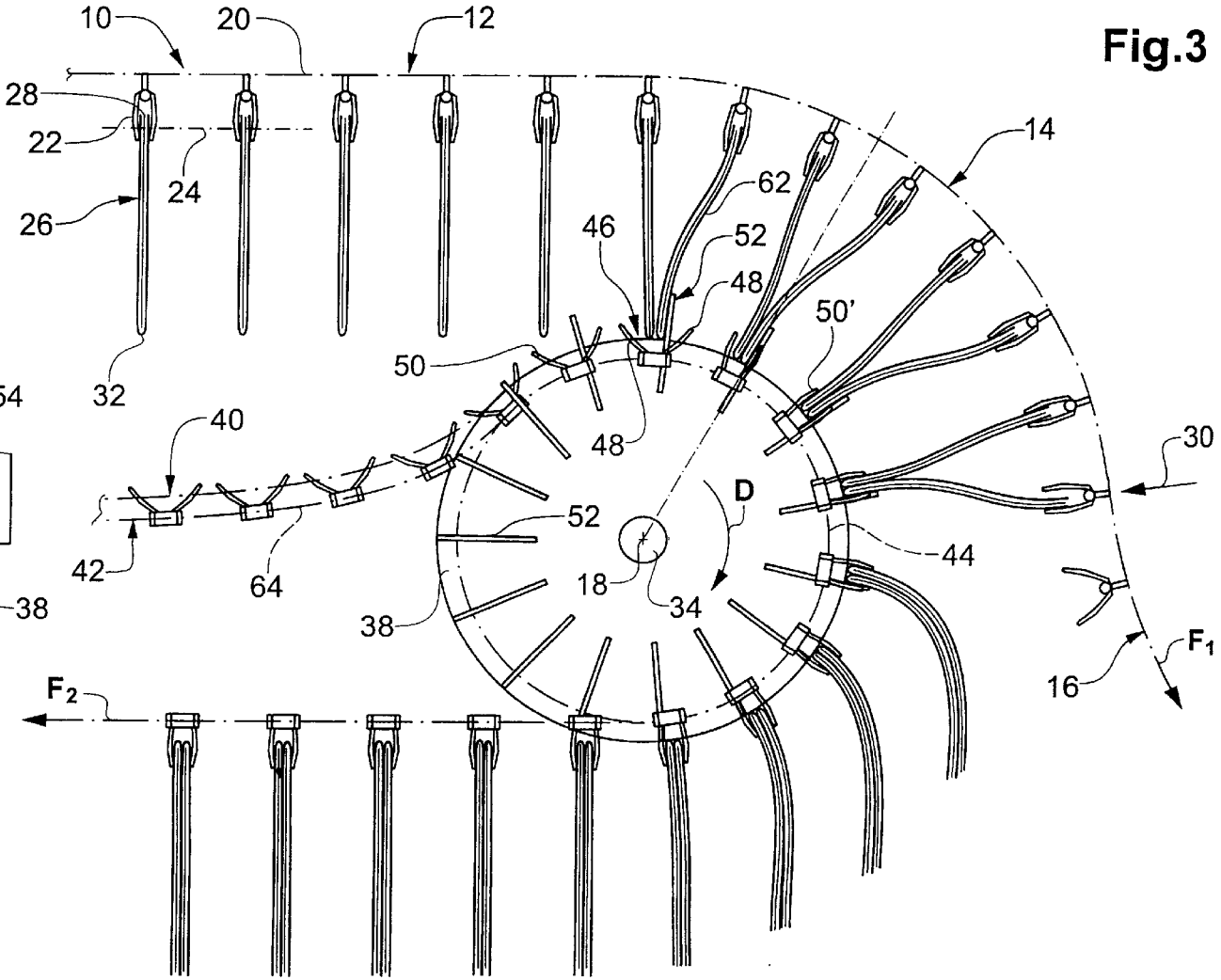
FIG. 3 shows, in the same illustration as in FIG. 1, the conveyor by means of which the articles arriving are transported and also a gripper conveyor by means of which in each case two of the articles are combined and conveyed away.

The apparatus shown in FIGS. 1 and 2 has a delivery conveyor 10 with a horizontal conveying section 12, an adjoining curved section 14, as seen in the conveying direction $F_1$, and a following, further curved section 16. The conveying section 12 and the two curved sections 14 and 16 are located in one vertical plane. The curved section 14 extends downwardly and follows a circle arc through approximately 90° around an axis 18, which is located beneath the conveying section 12. The further curved section 16 is curved in the opposite direction to the curved section 14.

The conveyor 10 is a clamp-type transporter which is known in general and has transporting clamps' 22 which are arranged at a spacing A one behind the other on a conveying means 20, for example a pulling means, which is driven continuously in circulation in the conveying direction $F_1$. The route taken by the transporting clamps 22 defines a conveying path 24 along which the flexible sheet-like articles 26 retained individually by the transporting clamps 22 are to be transported. In the present case, the articles 26 are printed products, such as newspapers, periodicals and the like.

By means of the transporting clamps 22, the rectangular articles, retained at a first, top edge 28, which in the region of the first curved section 14 is located on the outside, as seen in the radial direction, and runs parallel to the axis 18, are to be transported into the curved section 14 and released at the end of said curved section 14. For this purpose, there is arranged at this location an opening element 30, which is indicated by an arrow and by means of which the transporting clamps 22 running past it are changed over from a closed position into an open position. As can easily be gathered from FIG. 1, the multi-leaf folded articles 26 are retained at the first, open edge 28, which is located opposite the fold; the fold forms a second edge 32.

Seated on a shaft 34, which is coaxial with the axis 18, is a gripper wheel 36, which is driven at the same angular velocity in the direction of rotation D as the transporting clamps 22 in the curved section 14. As can be gathered from FIG. 2 in particular, the gripper wheel 36 has two circular carrying disks 38, between which circumferentially distributed grippers 40 are arranged. The gripper wheel 36 thus forms a gripper conveyor 42 with grippers 40 moved along a circular circulatory path 44 about the axis 18.

Each gripper 40 has two gripper jaws 48 which form a gripper mouth 46 and can be pivoted, symmetrically to a radial line, from a spaced-apart, open position 50 into a closed position 50' and back again. Grippers 40 of this type are known in general and are preferably activated via stationary guides. The grippers 40 are arranged at an angle $\alpha$ in relation to one another around the axis 18, said angle being twice the size of the angle between two transporting clamps 22 in the curved section 14. The spacing between the conveyor 10 and the gripper wheel 36 is selected such that, upon transfer from the conveying section 12 into the curved section 14, the second edges 32 of the articles 26 just come into contact with the circumference of the carrying disks 38 or come into close proximity therewith.

Each gripper 40 is assigned a supporting element 52, which in the present case is formed by two supporting plates 54 which are each arranged such that they can be displaced in the radial direction on one of the carrying disks 38. The displacement preferably takes place, in a known manner, by guide control and is in the same direction as the conveying direction $F_1$. The supporting element 52 is located at the pivot axis of the respectively leading gripper jaw 48 of the associated gripper 40, as seen in the direction of rotation D.

A removal conveyor 56 runs in the horizontal direction beneath the gripper wheel 36 and in the same vertical plane as the conveyor 10 and the grippers 40. Its transporting grippers 58, which are likewise arranged at a spacing B one behind the other on a pulling means 20', are constructed identically or similarly to the grippers 40 of the gripper wheel 36, the gripper mouths 46' being directed upward. The spacing between the carrying disks 38 and the base of the gripper mouths 46' corresponds at least more or less to the spacing between the first edge 28 and the fold 32 of the articles 26, as measured in the vertical direction beneath the axis 18. The spacing B between the transporting grippers 58 and their conveying speed $F_2$ are coordinated with one another such that in each case one transporting gripper 58 comes into contact with each gripper 40 vertically beneath the axis 18, vertically beneath the axis 18, the removal conveyor 56 is assigned a closing element 60, by means of which the transporting grippers 58, which arrive in the open position 50 in the conveying direction $F_2$, are to be transferred into the closed position.

The apparatus shown in FIGS. 1 and 2 functions as follows. Every second article 26 fed to the curved section 14 in a hanging position by the conveying section 12, just before reaching the curved section 14, runs onto a radially extended supporting element 52, by means of which it is supported on the leading side 62, as seen in the conveying direction $F_1$, in a region adjacent to the second edge. As can be gathered with reference to the straight chain-dotted radial lines, the supporting elements 52 are each aligned with the center between two transporting clamps 22, which results in the article 26 which passes into abutment against the supporting element 52 being bent slightly in the form of an S. When it runs through the vertical plane through the axis 18, or shortly after this, the article 26 following said first mentioned article 26 positions itself by way of its radially inner region, adjacent to the second edge 32, against that article 26 which is supported by the supporting element 52. As a result of the gravitational force, it is thus the case in the curved section 14 that the respectively trailing article 26 is bent slightly in the form of an S in the opposite direction to the leading article 26, with the result that the two articles 26 form a V. By virtue of the gripper 40 assigned to the relevant supporting element 52 being closed, the two articles 26 are gripped together, and secured, at the second edge 32.

The transporting clamps 22 release the relevant article 26 when they run past the opening element 30. As a result of their flexibility, the two articles 26, which are then each only retained by a gripper 40, bend such that their free end region hangs in the downward direction. In the region beneath the gripper wheel 36, a transporting gripper 58 comes into contact with each pair of articles 26 retained by a gripper 40, and said transporting gripper grips around said articles 26 from beneath, at their first edge 28, and, triggered by the closing element 60, grips them for being transported further, whereupon the associated gripper 40 is opened in order to release the respective articles 26.

The transporting grippers 58 are preferably arranged in a pivotable manner on the pulling means 20', in order to pivot the articles 26 forward, as seen in the conveying direction $F_2$, as FIG. 1 shows. It is also conceivable, however, for a pivoting movement to be executed in the rearward direction.

For the sake of completeness, it should be mentioned that, once the grippers 40 have been transferred into the closed position 50', the supporting elements 52 are displaced radially inward, with the result that the articles 26, which are retained in pairs by a gripper 40, are no longer supported by the supporting element 52. The region in which the articles 26 can bend in a downward direction is thus increased. Once the grippers 40 have been opened to the full extent, the supporting elements 52 are extended in the radial direction again, with the result that they achieve their radially outermost position again, at the latest, when they reach the top point of their circulatory path 44.

By means of the apparatus shown in FIG. 1, articles 26 arriving individually one behind the other, during continuous transportation, are combined in pairs and transferred, for being transported further, to the removal conveyor 56, which, for example with the transporting grippers 58 being spaced apart by the spacing B corresponding to the spacing A between the transporting clamps 22, only has to be driven at half the speed of the conveyor 10. It is not necessary, however, for the spacing B to correspond to that of A; all that will be required would be for the diameter of the gripper wheel 36 to be adapted in accordance with the ratio between the spacing. It is also conceivable for a gripper 40 to grip in each case more than two, for example three, articles 26, for which purpose the spacing between the grippers 40 would have to be adapted correspondingly.

Figure 4:
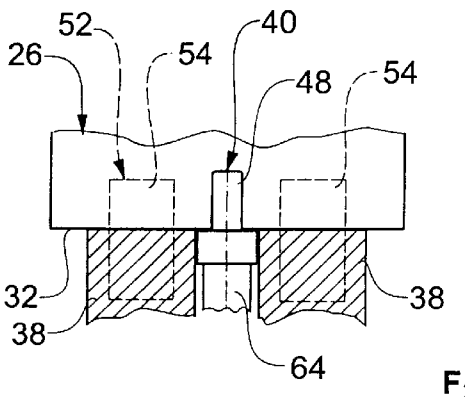
FIG. 4 shows, in the same illustration as in FIG. 2, part of the gripper conveyor and of a deflecting wheel with the supporting elements for the articles.

In the case of that embodiment of the apparatus according to the invention which is shown in FIGS. 3 and 4, the conveyor 10 is of the same design as in the case of the apparatus according to FIG. 1. It will thus not be described in any more detail. The designations correspond to those from FIGS. 1 and 2.

The gripper conveyor 42 of the embodiment according to FIGS. 3 and 4 is designed differently from that of the embodiment according to FIGS. 1 and 2. It has, in turn, two parallel carrying disks 38, on which the supporting plates 54, each forming the supporting element 52, are arranged such that they can be displaced in a radial direction. However, the grippers 40, rather than being arranged on the carrying disks 38, are now arranged on a further, endless pulling means 64. This is guided around the axis 18, between the carrying disks 38, such that a gripper 40 comes into contact with each supporting element 52, to be precise before the supporting elements 52 have reached the top point of their circular circulatory path around the axis 18 in each case. The carrying disks 38 are preferably provided with recesses or protrusions for the grippers 40. The grippers 40 then accompany the associated supporting element 52—in the region assigned to the curved section 14 of the conveyor 10—to a location vertically beneath the axis 18, where the grippers 40 leave the carrying disks 38 in a horizontal direction. In the region of the carrying disks 38, the grippers 40, together with the carrying disks 38, form a section of the gripper wheel 36 with the same function as has been described above in conjunction with FIGS. 1 and 2. The articles, which are gripped and retained in pairs by a gripper 40, are transported away in a hanging position by means of the endless gripper conveyor 42. In other words, the removal conveyor 56 of the embodiment according to FIGS. 1 and 2 has been replaced by the endless gripper conveyor 42.

Figure 5:
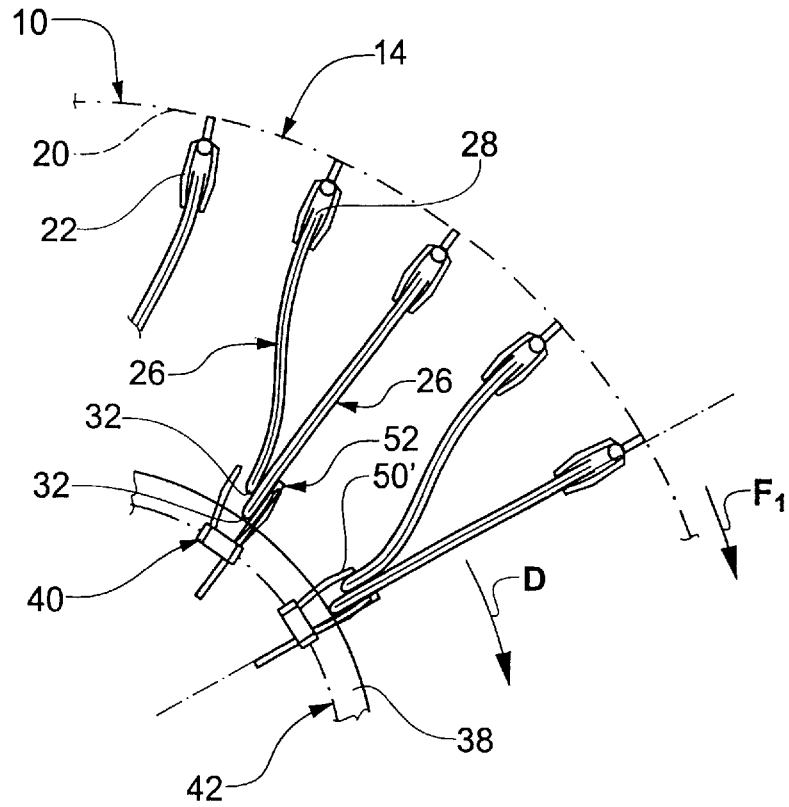
FIG. 5 shows, in the same illustration as in FIGS. 1 and 3, part of the apparatus shown there, in the case of which the supporting elements are aligned with the transporting clamp which retains the respectively leading article of the two articles which are to be combined.

FIG. 5 shows a detail of the first curved section 14 and two grippers 40 of the gripper conveyor 42 of the apparatus according to the invention according to FIGS. 1, 2 and 3, 4. The only difference, then, is that the supporting elements 52 and thus the grippers 40 assigned to them are aligned with the respectively leading transporting clamp 22, as seen in the direction of rotation D, of the two transporting clamps 22 which transport those articles 26 which are to be gripped by a gripper 40. This then results in the article 26 retained by the respectively leading transporting clamp 42, as a result of butting against the supporting element 52, remaining at least more or less in a radial plane rather than being bent counter to the conveying direction in the form of an S. However, the article 26 which is retained by the respectively trailing transporting clamp 22 bends in the form of an S to a more pronounced extent, which results in the second edges 32—the fold edges—assigned to these two articles 26 being offset in a radial direction, to be precise the second edge 32 of the trailing article 26 is located further outward, as seen in the radial direction, than that of the leading article 26. It is in this position in each case that the two articles 26 are gripped by the gripper 40 and secured for being transported further, with the result that, once it has been released by the transporting clamp 22, the trailing article 26 projects, by way of a strip-like end region adjoining the first edge 28, beyond the first edge 28 of the leading article 26. This makes it possible for the two articles 26 to be easily separated from one another for further processing.

Figure 6:
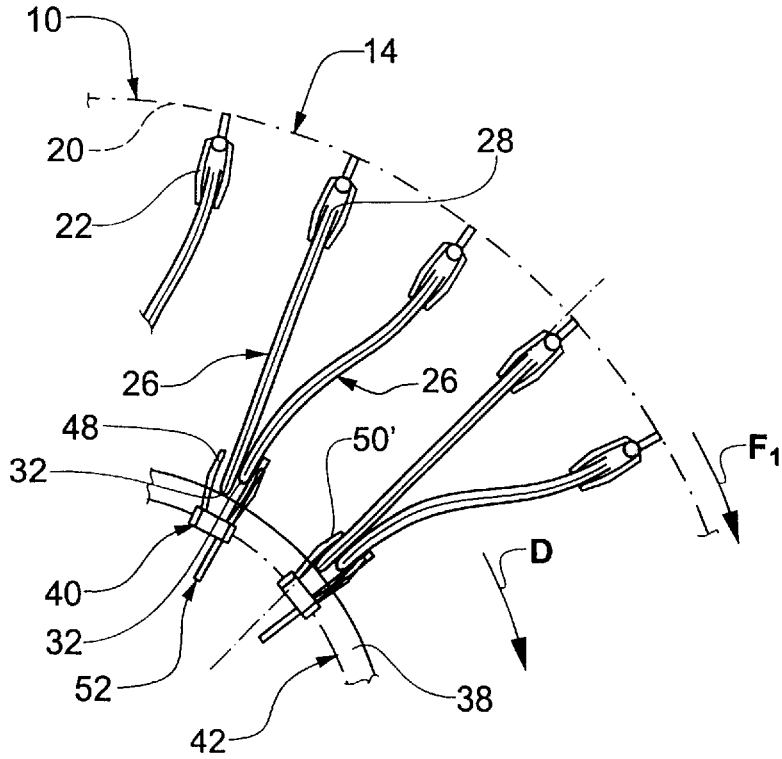
FIG. 6 shows, in the same illustration as in FIG. 5, part of the apparatus according to FIGS. 1 and 3, in the case of which the supporting elements are aligned with the transporting clamp which retains the respectively trailing article of the two articles which are to be combined.

In contrast to the design according to FIG. 5, in the case of that according to FIG. 6, the grippers 40 and associated supporting elements 52 are aligned with the transporting clamps 22 such that the trailing gripper jaw 48, as seen in the direction of rotation D, of the grippers 40 is located on a radial line together with that transporting clamp 22 of the conveyor 10 by means of which the trailing article of the two articles 26 which are to be gripped by the gripper 40 is transported up. This then results in the leading article 26, which butts against the supporting element 52, bending in the form of an S, while the trailing article 26 essentially maintains its planar form. The second edge 32 of the respectively leading article 26 is displaced radially outward in relation to that of the trailing article 26. Since, then, following release by the transporting clamp 22, the respectively leading article 26 projects, by way of a strip-like region adjoining the first edge 28, beyond the first edge 28 of the trailing article 26, straightforward separation of these articles 26 at a later stage is ensured.

By virtue of the phase displacement between the conveyor 10 and the gripper conveyor 42 being changed, it is possible to adjust the desired alignment of the supporting element 52 and gripper jaw 48.

Figures 7, 8:
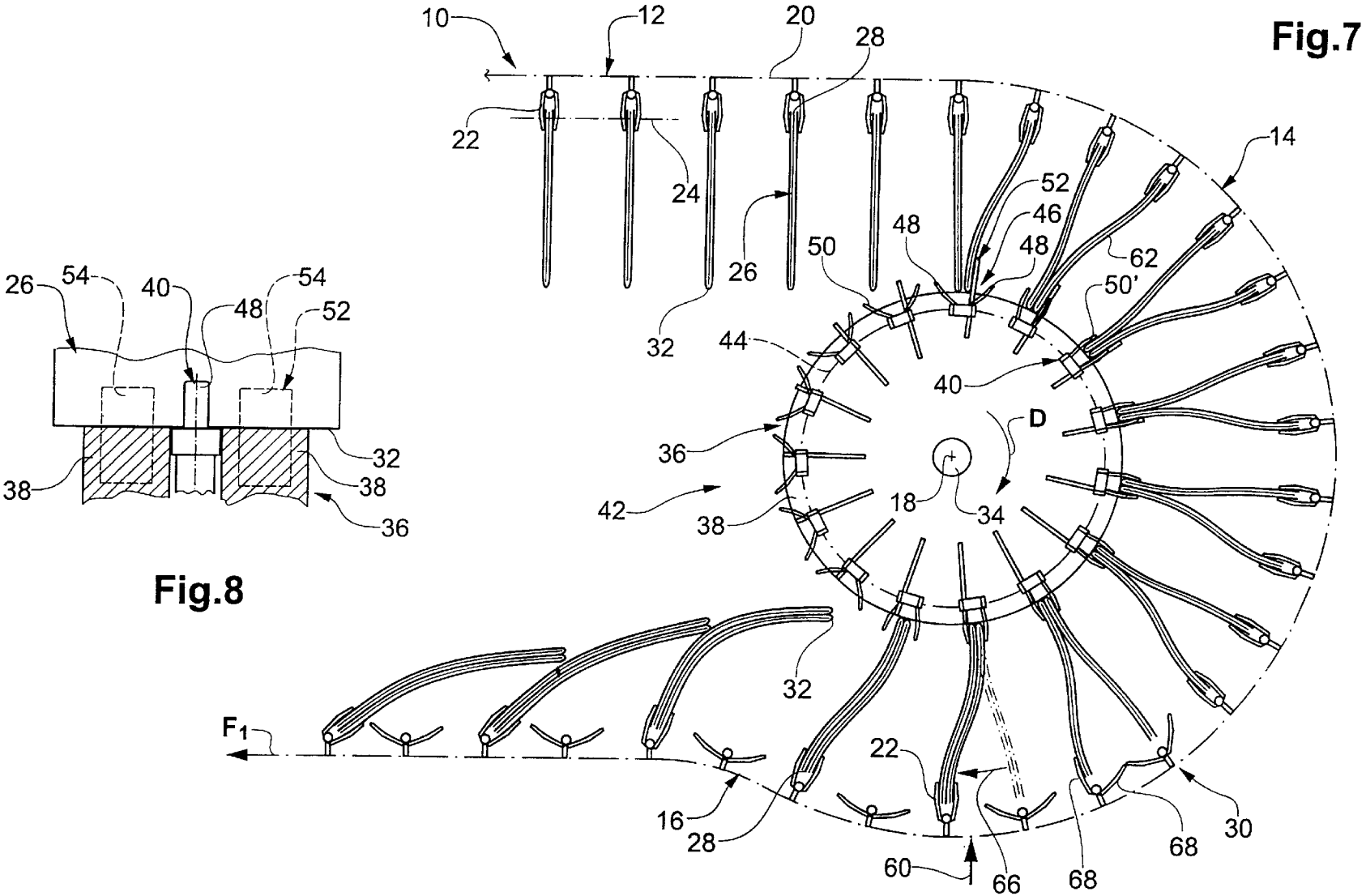
FIG. 7 shows, in the same illustration as in FIGS. 1 and 3, a further embodiment of the apparatus according to the invention, in the case of which the conveyor by means of which the articles arriving are transported also serves for transporting away the combined articles.
FIG. 8 shows, in the same illustration as in FIGS. 2 and 4, part of the wheel-like gripper conveyor according to FIG. 7.

In the case of the embodiment shown in FIGS. 7 and 8, the gripper conveyor 42 is designed as a gripper wheel 36, as is shown in FIGS. 1 and 2 and has been described above. In this case, however, the curved section 14 of the conveyor 10 extends coaxially around the axis 18 through more than 180°—in this case approximately 210°. The curved section 14 is adjoined by a further curved section 16, which is curved in the opposite direction and of which the downstream end runs in the horizontal direction. The difference from the embodiments which have been shown and described above is that the conveyor 10 of the embodiment shown in FIGS. 7 and 8 also serves for transporting away the articles 26 combined in pairs, although in this case it is only every second transporting clamp 22 which is active for transporting the articles away, which results in successive transporting clamps 22 having to be controlled differently.

The two jaws 68 at least of every second transporting clamp 22 are controlled individually. However, it is also possible for the jaws 68 of all the transporting clamps 22 to be controlled individually. Transporting clamps constructed in this way are known in general.

These successive transporting clamps 22 may be controlled differently, for example, in that the control elements for the jaws 68 of every second transporting clamp 22 are arranged on one side of the curved section 14 and those for the jaws 68 of the other transporting clamps 22 are arranged on the other side. When a transporting clamp 22 which secures the leading article of the two articles 26 retained by the associated gripper 40 reaches the 5 o'clock position—for example as seen in the illustration according to FIG. 7—the opening element 30 pivots the trailing jaw 68, as seen in the conveying direction $F_1$, of the transporting clamp 22 into the open position, while the leading jaw 68 maintains the approximately radially running closed position. The two jaws 68 of the trailing transporting clamp 22, however, are moved into the open position at the same time. The leading article of the two articles 26 is thus supported at its first edge 28 by a jaw 68, while the trailing article 26 has been released and positions itself flatly against the supported article 26. By means of the closing element 60, the trailing jaw 68 of the transporting clamp 22 assigned to the leading article of the two articles 26 is then pivoted into the closed position, as a result of which the two articles 26, butting flatly against one another, are now secured at their first edge 28 by the transporting clamp 22 for being transported away. The trailing transporting clamp 22 is not transferred into the closed position.

The arrow 66 indicates a pusher by means of which the trailing article of the two articles 26 retained by a gripper 40 is intended to be pushed, in the conveying direction $F_1$, into surface abutment against the leading article 26.

It is also possible for the supporting elements 52 to be arranged on the grippers 40 themselves rather than on carrying disks 38.

It also conceivable for the transporting clamps 22 and/or grippers 40 and/or transporting grippers 58 to be arranged on individual rail-guided carriages or slides.

That which is claimed:

1. A process for combining at least two flexible sheet-like articles during transportation so as to permit them to be jointly transported, comprising the steps of successively conveying a plurality of the articles in a conveying direction along a conveying path containing a curve, with the articles being individually retained at a first edge of the articles by transporting clamps on a delivery conveyor, upon reaching the region of the curve, sequentially gripping together groups of at least two successive articles on the delivery conveyor by means of respective grippers which each grip second radially inner edges of the at least two successive articles, and then releasing the gripped articles from the transporting clamps, so that the articles may be jointly transported further.

2. The process as claimed in claim 1, wherein the articles are conveyed to the curve in a hanging position and are gripped by respective grippers which are moved around an axis at generally the same angular velocity as the transporting clamps, with the respectively leading article of the at least two articles which are to be gripped by a gripper being supported on the front side, as seen in the conveying direction, at or adjacent the second radially inner edge.

3. The process as claimed in claim 2, wherein for being transported away, the in each case at least two articles retained by a gripper are received directly by a transporting clamp of the delivery conveyor or a transporting gripper of a removal conveyor.

4. The process as claimed in claim 3 wherein in each case the at least two articles which are received by a transporting clamp of the delivery conveyor or a transporting gripper of a removal conveyor are engaged at the first edges of the articles.

5. The process as claimed in claim 1 wherein the conveying path is initially substantially horizontal and the curve of the conveying path extends downwardly and defines a central generally horizontal axis, and wherein the first edges of the articles which are engaged by the transporting clamps are at the radially outer side of the articles as they move through the curve.

6. The process as claimed in claim 5 wherein the grippers are mounted on a wheel or an endless conveyor so as to move about an arcuate path which is inside the curve of the conveying path and is centered about the central axis.

7. The process as claimed in claim 6 wherein the transporting clamps on the delivery conveyor move through the curve at the same angular velocity and direction as the angular velocity and direction of the grippers moving along the arcuate path.

8. An apparatus for sequentially combining at least two flexible, sheet-like articles while being transported, and for jointly transporting them further, comprising a delivery conveyor which includes a plurality of transporting clamps which are arranged one behind the other, and which define a conveying direction along a conveying path containing a curve and by means of which the articles may be retained individually at a first edge, a gripper wheel or conveyor having grippers which are moved along a circulatory path located generally inside the curve of the conveying path, with said grippers being configured for gripping together in each case at least two successive articles on the delivery conveyor at a radially inner second edge of the articles and for securing them so that they may be transported further, and an opening element positioned adjacent the delivery conveyor for at least partially opening the transporting clamps once a gripper has gripped the relevant articles.

9. The apparatus as claimed in claim 8, wherein, at least in the region of the curve, each gripper is assigned a supporting element by means of which the respectively leading article of the at least two articles which are to be gripped by the gripper is supported on a front side as seen in the conveying direction, at or adjacent the second edge.

10. The apparatus as claimed in claim 8, wherein at least one section of the curve and the circulatory path run at least substantially concentrically about a horizontal axis, and wherein the transporting clamps and the grippers are driven at substantially the same angular velocity in this one section, and wherein the transporting clamps, upon reaching the curve, are directed downward in order to transport the articles in a hanging position.

11. The apparatus as claimed in claim 10, wherein arranged beneath the gripper wheel or conveyor is a removal conveyor, by means of which, for being transported away, the in each case at least two articles retained by a gripper are received directly by means of an upwardly directed transporting gripper.

12. The apparatus as claimed in claim 10, wherein the grippers are arranged on an endless conveyor which is driven in circulation and is guided around the horizontal axis.

13. The apparatus as claimed in claim 12, wherein the endless conveyor is guided around a deflecting wheel which is coaxially disposed with respect to said horizontal axis.

14. The apparatus as claimed in claim 13 wherein the deflecting wheel mounts a plurality of supporting elements which are circumferentially spaced so as to cooperate with respective ones of grippers on the endless conveyor, and whereby the leading article of the associated at least two articles which are to be gripped by each gripper is supported on its front side as seen in the conveying direction at or adjacent the second edge by the associated supporting element.

15. The apparatus as claimed in claim 10 wherein a section of the conveying path which is downstream of the curve runs beneath the circulatory path of the grippers, so that the transporting clamps are directed upward when they run through said section 50 that selected ones of the transporting clamps receive the at least two articles retained by each gripper at the first edges thereof.

* * * * *